US006367106B1

(12) United States Patent
Gronsman

(10) Patent No.: US 6,367,106 B1
(45) Date of Patent: Apr. 9, 2002

(54) THERAPEUTIC SUPPORT FOR THE REDUCTION OF DECUBITUS ULCERS

(75) Inventor: Steven M. Gronsman, Grand Rapids, MI (US)

(73) Assignee: Sand Therapeutic, Inc., Hudsonville, MI (US)

( * ) Notice: Subject to any disclaimer, the term of this patent is extended or adjusted under 35 U.S.C. 154(b) by 0 days.

(21) Appl. No.: 09/162,004

(22) Filed: Sep. 28, 1998

Related U.S. Application Data

(60) Provisional application No. 60/075,393, filed on Feb. 20, 1998.

(51) Int. Cl.[7] ..... A47C 27/18

(52) U.S. Cl. ..... 5/709; 5/655.3; 5/910; 5/713

(58) Field of Search ..... 5/709, 706, 644, 5/654, 655.3, 932, 713; 297/284.1, 284.6, 284.7, 284.5, DIG. 8

(56) References Cited

U.S. PATENT DOCUMENTS

| | | | | |
|---|---|---|---|---|
| 2,779,034 A | | 1/1957 | Arpin | |
| 3,303,518 A | | 2/1967 | Ingram | |
| 3,486,177 A | | 12/1969 | Marshack | |
| 3,616,471 A | | 11/1971 | Braun | |
| 3,730,588 A | | 5/1973 | Braun | |
| 3,987,507 A | | 10/1976 | Hall | |
| 4,045,830 A | | 9/1977 | Loeb et al. | |
| 4,114,214 A | | 9/1978 | VonHeck | |
| 4,234,982 A | | 11/1980 | Bez et al. | |
| 4,254,518 A | | 3/1981 | Buhren et al. | |
| 4,347,213 A | | 8/1982 | Rogers, Jr. | |
| 4,982,465 A | * | 1/1991 | Nagata et al. | 5/709 X |
| 5,029,939 A | * | 7/1991 | Smith et al. | 287/284 |
| 5,142,717 A | * | 9/1992 | Everard et al. | 5/709 |
| 5,159,726 A | | 11/1992 | Bloch et al. | |
| 5,388,292 A | * | 2/1995 | Stinson et al. | 5/709 X |
| 5,394,577 A | | 3/1995 | James et al. | |
| 5,414,884 A | | 5/1995 | Mackenzie | |
| 5,556,169 A | | 9/1996 | Parrish et al. | |
| 5,815,864 A | * | 10/1998 | Sloop | 5/706 |

FOREIGN PATENT DOCUMENTS

| | | |
|---|---|---|
| GB | 959103 | 5/1964 |
| WO | WO 86/02244 | 4/1986 |
| WO | WO 98/30133 | 7/1998 |

* cited by examiner

*Primary Examiner*—Lynne H. Browne
*Assistant Examiner*—Fredrick Conley
(74) *Attorney, Agent, or Firm*—Rader, Fishman, Grauer & McGarry, an Office of Rader, Fishman & Grauer PLLC

(57) ABSTRACT

The invention relates to a therapeutic seat or bed for reducing the likelihood of decubitus ulcers, which can form in the skin surrounding a weight-bearing bony protrusion. The seat or bed includes one or more compressible supports in a cushion that can be moved between a compressed, relaxed, or inflated state to relieve pressure from the skin surrounding the bony protrusion to increase the blood flow or stimulate the blood flow through the area surrounding the bony protrusion.

33 Claims, 16 Drawing Sheets

THERAPEUTIC SUPPORT FOR THE REDUCTION OF DECUBITUS ULCERS

This application claims the benefit of United States Provisional Patent Application Ser. No. 60/075,393, filed Feb. 20, 1998.

BACKGROUND OF THE INVENTION

1. Field of the Invention

The present invention relates to a therapeutic support for the human body; and, more particularly, to a therapeutic support such as a seat or a bed that aids in the healing of decubitus ulcers and reduces the likelihood of formation of such ulcers.

2. Description of the Related Art

It is well known that non-ambulatory or partially immobile people who are confined to beds, chairs, wheelchairs, and the like may suffer from the formation of decubitus ulcers, also known as pressure ulcers, pressure sores, and bedsores. Decubitus ulcers are generally formed by a reduction or absence of capillary blood flow in the sufferer's skin. For a non-ambulatory or partially immobile person, the reduction or absence of capillary blood flow is primarily caused by the weight-bearing bony protrusions compressing the skin against a support such as a bed or wheelchair, with the person remaining in the same position for an extended period of time. The compression of the skin by the weight-bearing bony protrusion reduces or stops the capillary blood flow in that area of the skin, leading to necrosis and the formation of a decubitus ulcer.

The formation of a decubitus ulcer is exacerbated by the existence of moisture from perspiration or incontinence, for example, which are often associated with non-ambulatory or partially immobile persons.

For a person who uses a wheelchair, the coccyx and ischials are the principal weight-bearing bony protrusions, and the adjacent areas of skin are the most likely locations for the formation of decubitus ulcers. Previous wheelchair seat designs have not adequately addressed the therapeutic need for relieving pressure on the person's skin in the coccyx and ischial areas to reduce the likelihood of decubitus ulcers.

In the case of a person constrained to spend long periods in a bed, the areas of the coccyx and ischials remain a problem, but problem areas also include, without limitation, the heels, ankles, shoulder blades, elbows and wrists.

SUMMARY OF THE INVENTION

The invention is a therapeutic support such as a seat or bed that reduces the likelihood of the formation of a decubitus ulcer. Preferably, the therapeutic seat or bed prevents the extended loss or reduction of capillary blood flow to the weight-bearing areas of a seated or reclining person. Additionally, the therapeutic support provides for the removal of moisture from the weight-bearing areas. A therapeutic seat or bed according to the invention is capable of performing these functions individually or in combination.

More particularly, the invention provides such a therapeutic support which includes a cushion sized to support one or more bony protrusions or weight-bearing areas of a body placed in contact with its upper surface and formed with at least one cell cell cavity at a location respectively corresponding to one of the weight-bearing portions of the body. A compressible cell is received in the cavity. The cell has a configuration complementary to the cavity in which it is received. Preferably, the therapeutic support has multiple cavities with a corresponding number of cells. At least one cell is associated with such weight-bearing area supported by the seat. There can be multiple cells associated with one or more of the weight-bearing areas.

Each of the cells is compressible from a relaxed state to a compressed state. When a cell is in the relaxed state, its upper surface portion is preferably substantially at the height of the upper surface of the cushion. When a cell is in its compressed state, its upper surface portion is preferably lower than the upper surface of the cushion. Thus, when any one of the cells is in its relaxed state, the upper surface of the cushion and the upper surface portion of that cell form a substantially continuous surface for supporting the non-weight-bearing areas of the body and the weight-bearing area corresponding to that cell. When, on the other hand, any one of the cells is in its compressed state, pressure on the corresponding weight-bearing area is reduced.

In an alternative construction, the support can include a base one which the cells are supported. The base can, but need not, have a cushion. The base includes hollowed portions fluidly connecting some of the cells to define cell subsets whose state are changed concurrently to form zones. Preferably, each zone is associated with a different weight-bearing area and each zone is independently controlled.

In a preferred construction, each of the cells comprises a resilient compressible core and a flexible bladder enveloping the core. One end of a fluid conduit extends into the bladder so that when a negative pressure is applied to the conduit, fluid in the bladder is drawn out to contract the bladder and thus compress the core.

Other features and advantages of the invention will be apparent from the ensuing description in conjunction with the accompanying drawings.

DETAILED DESCRIPTION OF THE PREFERRED EMBODIMENTS

For purposes of illustration and explanation, the following detailed description is directed to therapeutic seats useful for employment in wheelchairs, and therapeutic mattresses useful in beds and the like. It will be apparent to the person of skill in the art, however, that the principles of the invention so illustrated and explained are readily applicable to such other supports as couches, recliners, chaise longues, chairs, surgical tables, seats for motor cars and trucks, and the like.

Figure 1:
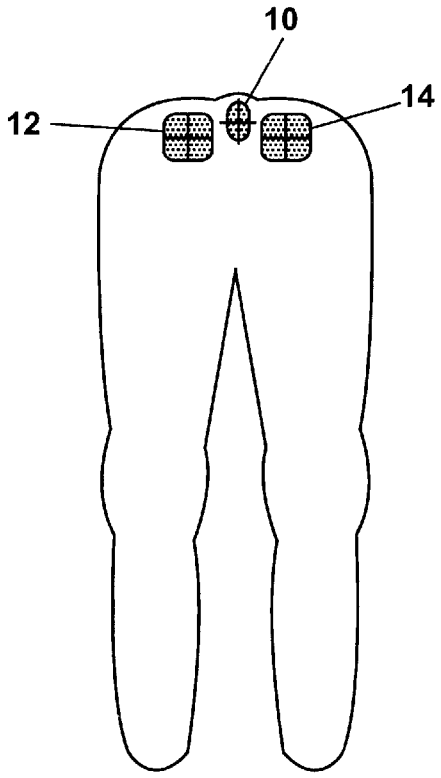
FIG. 1 is a diagrammatic view of the posterior of the lower torso and legs of a person, illustrating the location of the coccyx and the ischial areas of the human body.

FIG. 1 illustrates the coccyx area 10 and ischial areas 12 and 14 of the human body that are the major weight-bearing areas for a person seated in a wheelchair for example. The crosshair in each of the coccyx area 10 and ischial areas 12, 14 represents the location of the coccyx and ischial bony protrusions. The boundaries of the areas 10, 12, 14 generally represent the possible variation in the location of the coccyx and ischial bony protrusions for average adult males and females. The skin surrounding the coccyx area 10 and ischial areas 12 and 14 is susceptible to formation of decubitus ulcers because of the reduction or absence of blood flow in these areas resulting from the coccyx's and ischials' compressing the skin against the wheelchair seat.

Figure 2:
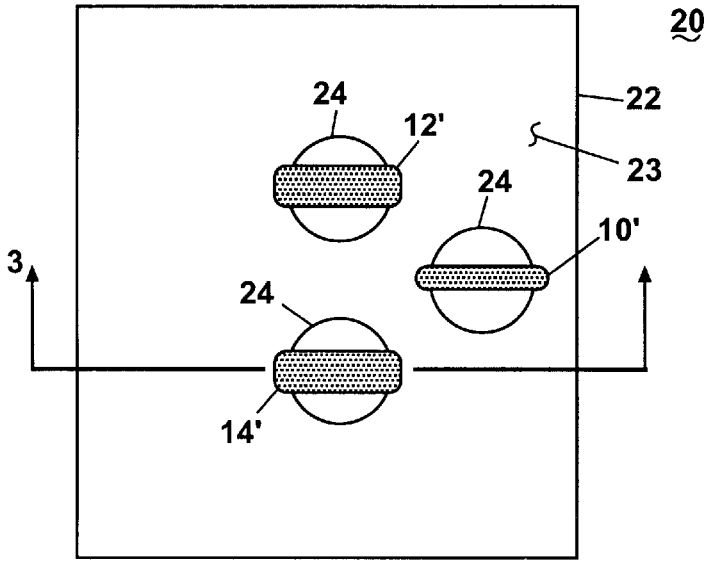
FIG. 2 is a plan view of a first embodiment of a therapeutic support according to the invention, comprising a therapeutic seat which includes a cushion having compressible foam cells corresponding to the coccyx and ischial areas.
Figure 3:
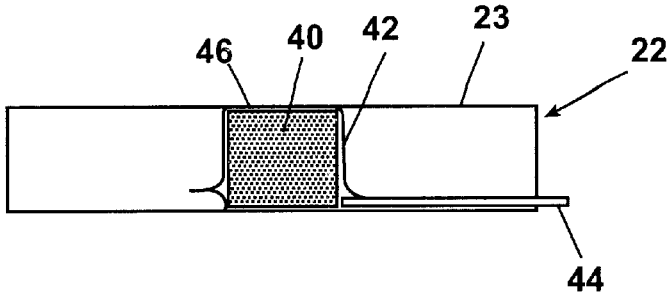
FIG. 3 is a sectional view taken along lines 3—3 of FIG. 2, showing a compressible cell comprising a compressible core enveloped by a bladder.
Figure 4:
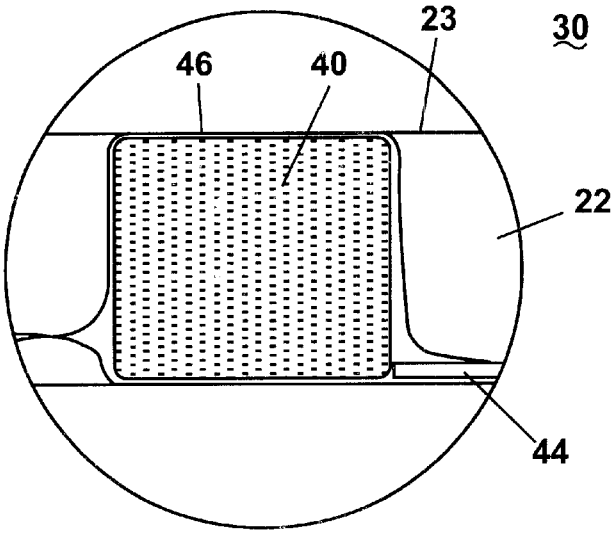
FIG. 4 is an enlarged view of the compressible cell of FIG. 3 in a relaxed state.
Figure 5:
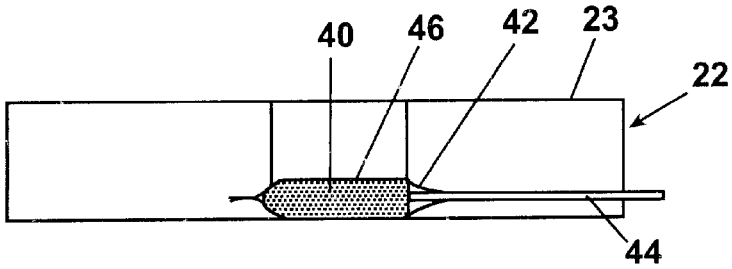
FIG. 5 is a view similar to that of FIG. 3 but showing the compressible cell in the compressed state.

FIG. 2 illustrates a first embodiment of a therapeutic support according to the invention, comprising a seat 20 that reduces the likelihood of the creation of decubitus ulcers by periodically reducing the pressure against the coccyx area 10 and ischial areas 12, 14 while the person is seated on the seat 20. The shaded areas 10', 12' and 14' illustrate the likely location of the coccyx and ischials of an average person when seated on the seat. The actual locations of the coccyx and ischials vary depending upon the person's seating posture.

Referring to FIGS. 2 to 5, the therapeutic seat 20 comprises a base or seat cushion 22, preferably made of a compressible, resilient material, such as polyurethane foam, or viscoelastic foam, or an open-cell, anti-microbial foam, which may be provided in layers (FIG. 9); for example, a firm lower layer of relatively high density, and a less-firm upper layer of relatively low density. The seat cushion 22 is formed with three cavities 24 extending through an upper surface 23 of the cushion end, the cavities corresponding to the coccyx area 10 and ischial areas 12 and 14, respectively, of a person's body when seated on the therapeutic seat 20.

Compressible cells 30 are provided within each of the seat cavities 24. The compressible cells 30 are identical, and therefore only one need be described in detail. The cell 30 comprises a core 40 preferably made from the same opencell, anti-microbial foam as the base 22. The foam should be resilient and capable of many compression cycles without substantially losing the needed resiliency to return to its uncompressed or relaxed state. Suitable foams are, for example, a viscoelastic foam such as Sunmate Foam™, available from Dynamic Systems, Inc. The core may have any transverse shape but is preferably circular with a diameter of three inches, and is in any case complementary to the shape of the seat cavity 24.

A generally gas-impermeable bladder 42 surrounds the core 40 and receives a fluid conduit 44, which is connected to a vacuum pump 48 by way of a valve manifold 50. The bladder has an upper surface portion 46. The valve manifold 50 is provided with multiple valves (not shown), each of which corresponds to one of the fluid conduits 44. The valve manifold connects each fluid conduit alternately between the ambient atmosphere, to apply ambient pressure to the corresponding cell, and the vacuum pump, to apply a lower pressure than ambient or a higher pressure than ambient to the cell, depending upon whether the vacuum pump is being operating as a negative-pressure or positive-pressure pump. The bladder 42 is preferably made from neoprene or rubber.

Other materials such as PVC, polyurethane, polyethylene and silicone are also suitable. Neoprene has the advantage of rubber (latex), but will not trigger allergic reactions in those users who are allergic to latex.

Figure 6:
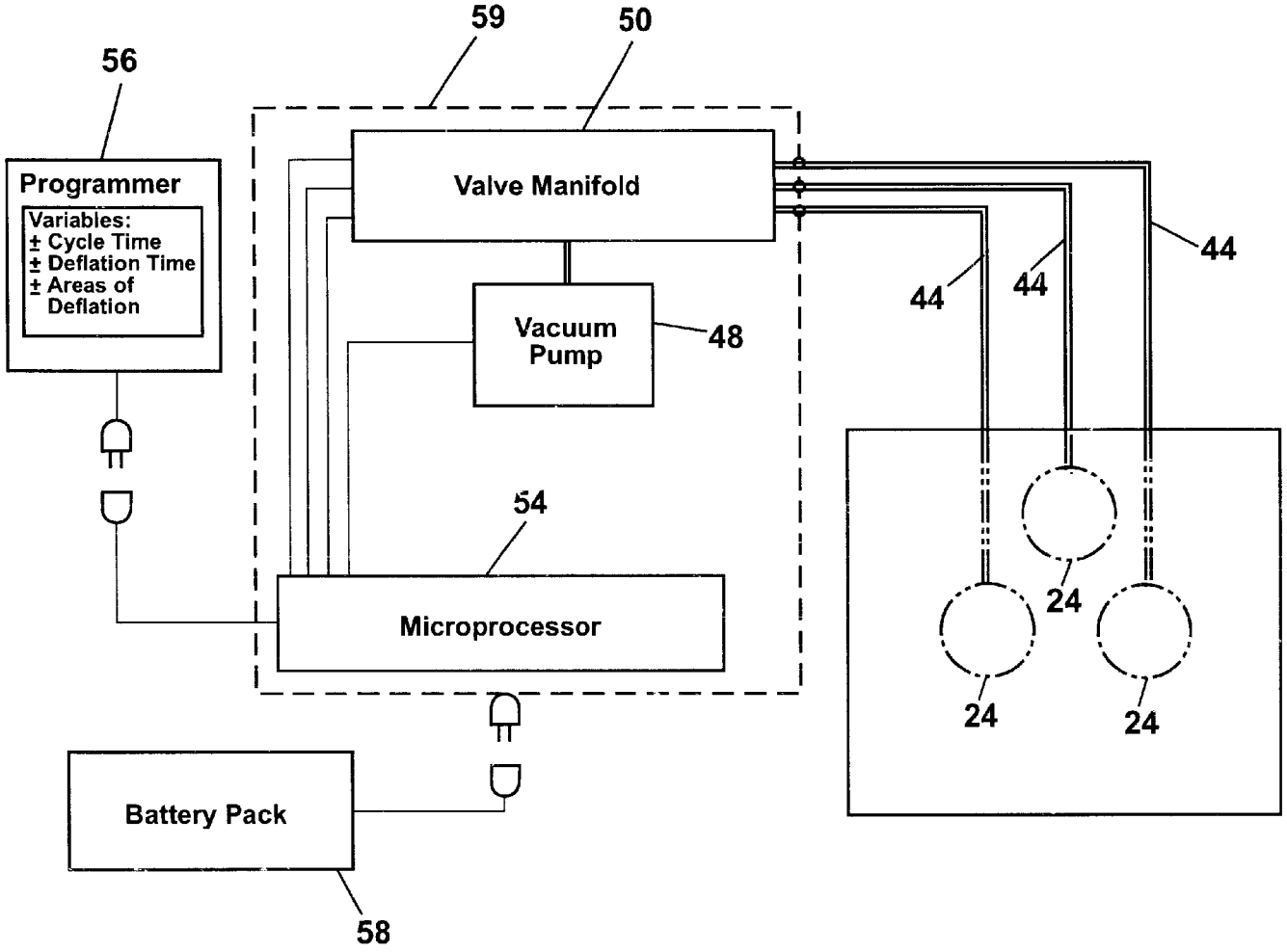
FIG. 6 is a diagrammatic view of a system for control of the operation of a therapeutic seat according to the invention.

FIG. 6 schematically illustrates the functional interaction of a programmer 56 for reprogramming a microprocessor 54 that is responsible for controlling the operation of the vacuum pump 48 and the valve manifold 50 to compress the cells 30. The pump box 59 preferably comprises a microprocessor 54 coupled to the vacuum pump 48 and the valve manifold 50 to thereby send control signals to the vacuum pump 48 and valve manifold 50 and receive operational data from the vacuum pump 48 and the valve manifold 50. Power is provided to the pump box 59 by a battery pack 58. The programmer 56 preferably has a LCD display for displaying various operational parameters, such as cycle time, compression time, and selected compression cells, which can be changed and stored in memory in the microprocessor 54. Preferably, the programmer includes four switches for adjusting respective parameters for mode, change variable up, change variable down, and save. The programmer 56 draws power from the battery pack 58. Advantageously, the system operates at 12 vdc and can be connected to an automobile electrical system, preferably by way of the cigarette lighter socket or connected to a 120 vac household socket by way of an adapter.

In the preferred embodiment, the vacuum pump 48, valve manifold 50 and microprocessor 54 are all contained within a single unitary structure or housing, such as a vacuum pump box 59, which is preferably mounted to the wheelchair supporting the seat 20. The programming unit 56 and battery pack 58 are removably coupled to the vacuum pump box through standard input/output and electrical connectors. These types of connectors are well known in the art and do not warrant further description.

Figures 7, 7A, 7B, 7C:
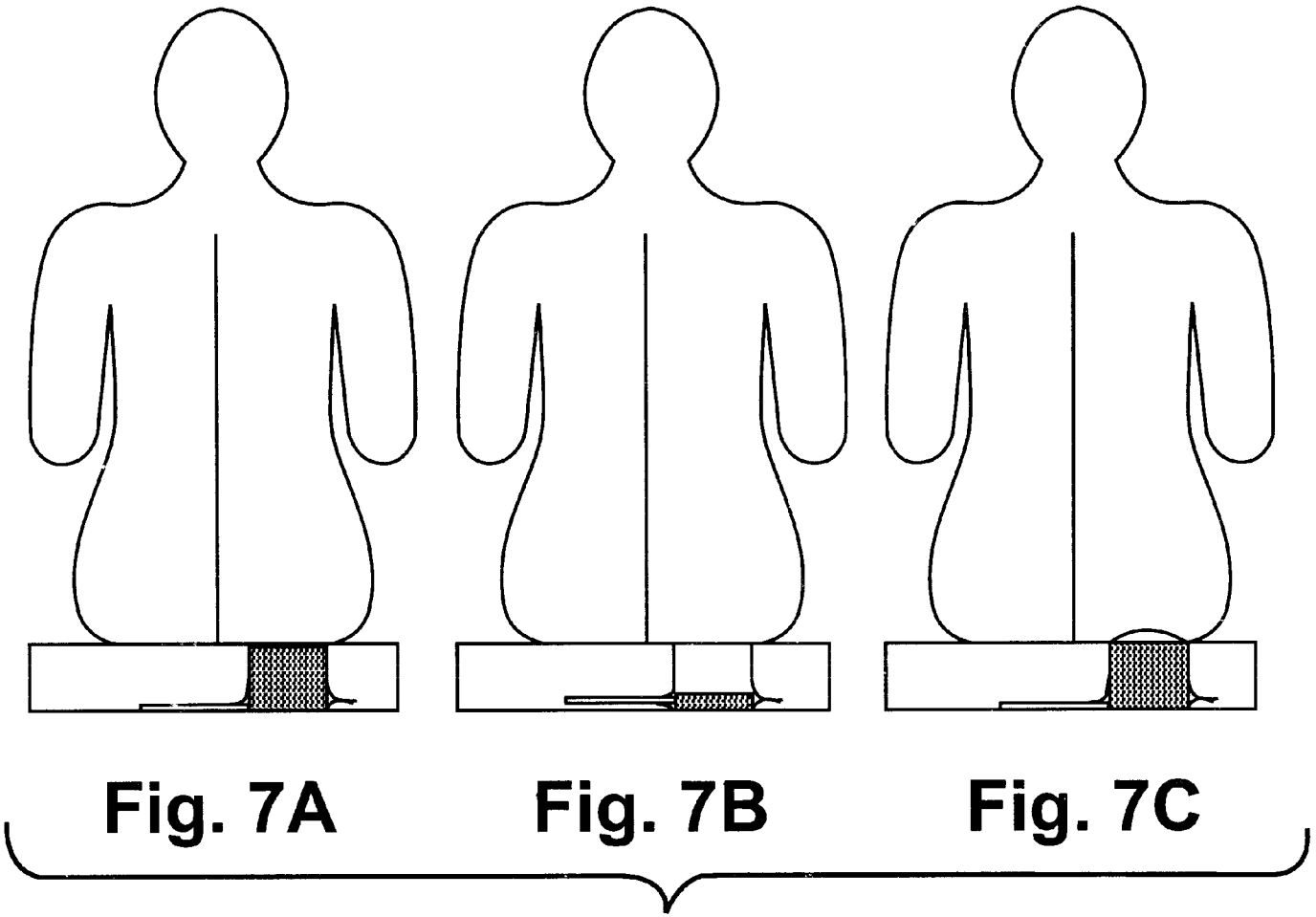
FIG. 7 illustrates the principal operating states of a compressible cell of a therapeutic seat according to the invention; and more particularly, showing the relaxed state (FIG. 7*a*), the compressed state (FIG. 7*b*), and the inflated state (FIG. 7*c*)

In operation, referring to FIGS. 6 and 7, the user or medical assistant enters the programming parameters through the programming unit 56. Generally, it is only necessary to enter the cycle time, compression time, and cell selection. The cycle time is the time each cell is in the compressed, relaxed, and/or inflated state for a given sequence until the sequence repeats itself for the next cell, and the deflation time is the total time the cell deflates. Preferably, the cycle time is 50 seconds with a 40-second compression time. As will be apparent, the combination of a 50-second cycle time and a 40-second compression time results in the cell being in the compressed state for 40 seconds and in the relaxed state for 10 seconds. The timing sequence is infinitely adjustable depending on each individual's needs or preferences.

At the beginning of a new cycle, all the cells are in their relaxed state. That is, the compressible core of each plug is exposed to the ambient pressure, which is controlled by the microprocessor 54 instructing the valve manifold 50 to open the fluid conduits 44 to the ambient atmosphere surrounding the seat 20. In the relaxed state, the bladder upper surface portion 46 is substantially continuous with the cushion upper surface 23 to define an overall therapeutic support or seat upper surface that supports both the weight-bearing and non-weight-bearing areas of the posterior.

After the operational parameters are entered, the microprocessor 54 determines the selected cells for compression and instructs the valve manifold 50 to connect the fluid conduits 44 of the selected cells to the vacuum pump 48. The vacuum pump 48 is then controlled by the microprocessor 54 to generate a negative pressure gradient that is applied to the selected cells through the valve manifold 50 and the fluid conduits 44. The application of a negative pressure gradient to the cells results in air being drawn from the interior of the bladder of each of the selected cells through the fluid conduit 44, resulting in the constriction of the bladder and compression of the core for each of the selected cells. As the cells are compressed, they are reduced in height from the relaxed state as shown in FIG. 7*a* to the compressed state as shown in FIG. 7*b*, where the cell upper surface portion 46 is below the cushion upper surface portion, thereby relieving pressure from the selected weight-bearing areas.

Once the desired reduced pressure is reached, the microprocessor turns off the vacuum pump 48 and the cells are held in their compressed state for the duration of the compression time. At the end of the compression time, the microprocessor 54 instructs the valve manifold 50 to open the fluid conduits 44 of the selected cells to the ambient pressure or positive pressure gradient. Since the core of each of the selected cells is formed of a resilient material, the cell naturally returns to its relaxed state when the cell is fluidly connected to the ambient pressure and remains there until the passing of the cycle time at which the process is repeated.

When a person is initially seated on the therapeutic seat 20, all of the compressible cells 30 are relaxed. In the relaxed position, the weight-bearing coccyx area 10 and ischial areas 12, 14 press against their corresponding compressible cells 30. When the selected compressible cells are compressed, however, the seated person's weight is transferred from the coccyx and ischial areas to the areas of the posterior surrounding the coccyx and ischial areas. The removal of the weight-bearing pressure from the coccyx and ischial areas acts to increase capillary blood flow through these areas, thus reducing the likelihood of the development of decubitus ulcers.

The seat cushion 22 of the therapeutic seat 20 may be provided with a cover of permeable material that beneficially permits the transfer of moisture into the seat cushion and away from the seated person to further reduce the likelihood of formation of decubitus ulcers. Similarly, the bladder 42 may also be made from a permeable or perforated membrane that permits the drawing of fluid by way of the membrane through the core 40 and out through the conduit 44. The only limitation on such a permeable membrane is that the inflow rate through the membrane must not exceed the outflow rate created by the vacuum pump to ensure the compressibility of the compressible cells 30.

Although the preferred invention requires that the cycle time, compression time, and the selected cells be entered by a user, it is within the scope of the invention to provide for fewer or more operational parameters to be entered by a user. For example, the cycle time, compression time and selected cells may all be fixed at predefined values, which would result in a less expensive control system, but would reduce the flexibility and adaptability of the control system to a particular user's needs. As another example, the cells do not need to be compressed simultaneously. It is within the scope of the invention for a subset of the total number of cells to be selected and the sequence in which the subset of cells is compressed, which may result in some cells having overlapping compression times and other cells not having overlapping compression times. These parameters can be selected and additional parameters can be added or deleted depending on the needs of a particular user.

Referring to FIG. 7, it is worth noting that the cells cannot only be operated between the previously described relaxed state (FIG. 7*a*) and a compressed state (FIG. 7*b*), but can also be operated in an inflated state (FIG. 7*c*), where the upper surface 46 of the bladder extends beyond the upper surface 23 of the cushion 20 to inflate the cell, the microprocessor 54 need only instruct the vacuum pump 48 to apply a positive pressure gradient to the valve manifold 50, which by instruction of the microprocessor 54 will fluidly connect the fluid conduit 44 of the selected cells to the positive pressure gradient. The introduction of the positive pressure gradient into the selected cells will expand the flexible bladder material to move the cell to the inflated state. In the inflated state, the cell applies pressure to the corresponding weight-bearing area. Although the application of pressure to the weight-bearing area may appear, at first glance, to be antithetical to the function of the invention, it has been found that a non-continuous application of pressure to a weight-bearing area, such as one of the coccyx and ischial areas, results in the stimulation of blood flow to the weight-bearing area. It is the continuous application of pressure to a weight-bearing area over a threshold time frame that results in the reduction of blood flow in the weight-bearing area and the possible formation of a decubitus ulcer.

It is preferred that the upper surface of the cell be positioned above the upper surface of the cushion in the inflated state, substantially level with the upper surface of the cushion in the relaxed state, and below the upper surface of the cushion in the compressed state. However, it is within the scope of the invention for the upper surface of the cell to lie below, equal to, or above the upper surface of the cushion in any of the compressed, relaxed, or inflated states. The location of the cell upper surface relative to the cushion upper surface will vary depending on such factors as seat construction and therapeutic needs.

Although the cell is described as a core of resilient material, such as open-cell foam, and a separate encapsulating bladder of a material such as neoprene or latex, it is within the scope of the invention for the cell to be made from a single material. A suitable example would be an open-cell foam on whose outer surface is formed an impermeable skin during the molding process by applying heat to the exterior of the molds to melt the surface of the foam. Moreover, although the fluid conduits 44 are shown as tubes extending from the cell to the valve manifold, it is possible that the tubes 44 can be formed integrally with the seats 20 or with the wheelchair structure or similar device on which the seat 20 is placed.

Figure 8:
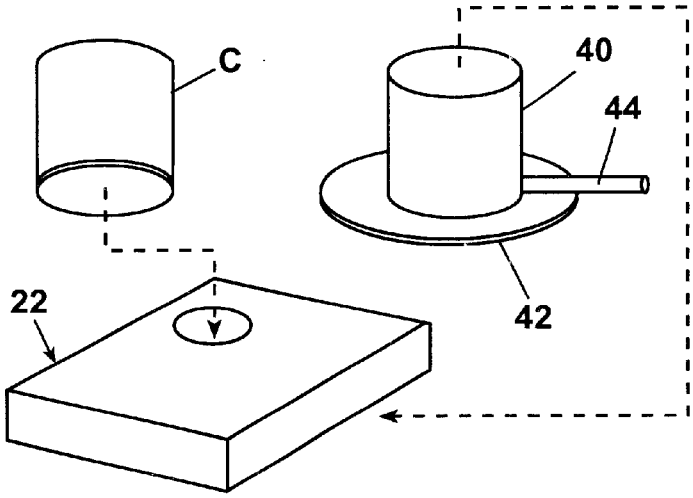
FIG. 8 illustrates a method of making the therapeutic seat of FIG. 2.

Referring to FIG. 8, the seat 20 according to the invention is preferably manufactured by taking a suitable tool such as a cell cutter C and cutting a cell core from the cushion 22. The cell core is then removed from the tool C and placed on the unformed bladder 42. The fluid conduit 44 is also placed on top of the unformed bladder 42. The bladder 42 is then wrapped around the cell core 40 and the fluid conduit 44. The edges of the bladder 42 are then sealed to encapsulate the core 40 and a portion of the fluid conduit 44. The completed cell is then inserted in the cavity in the cushion 22 left by the removal of the core 40.

The method of forming the seat 20 illustrated in FIG. 8 is the preferred method when the cells have a circular shape and their core is to be made from the same material as the cushion. However, other assembly methods are within the scope of the invention and will depend on the particular characteristics of the seat.

Figure 9:
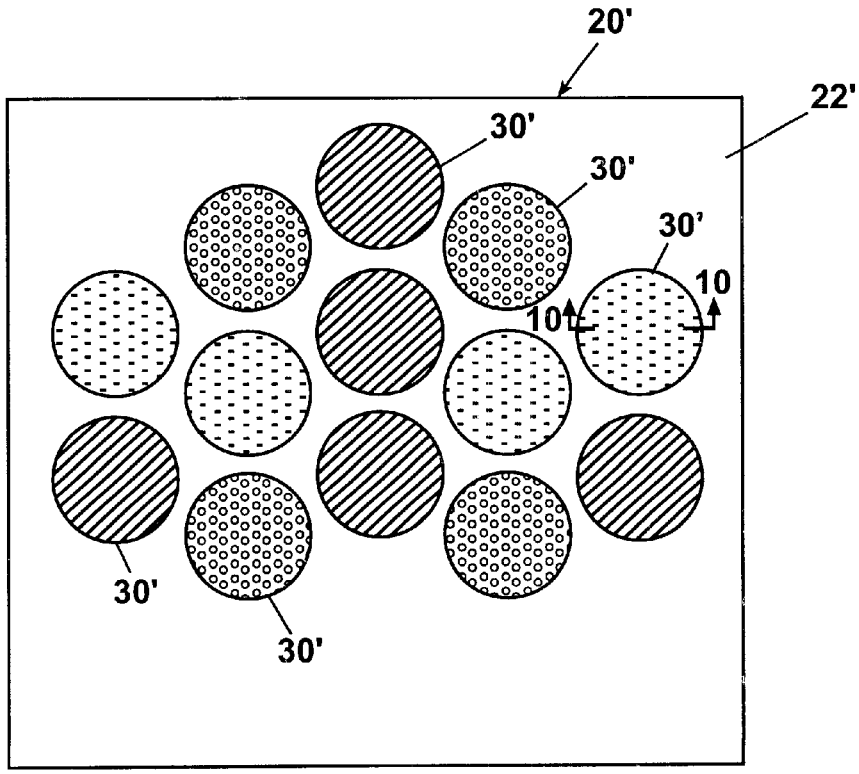
FIG. 9 illustrates a first alternative cell pattern for the cells of a therapeutic seat according to the invention.
Figure 10:
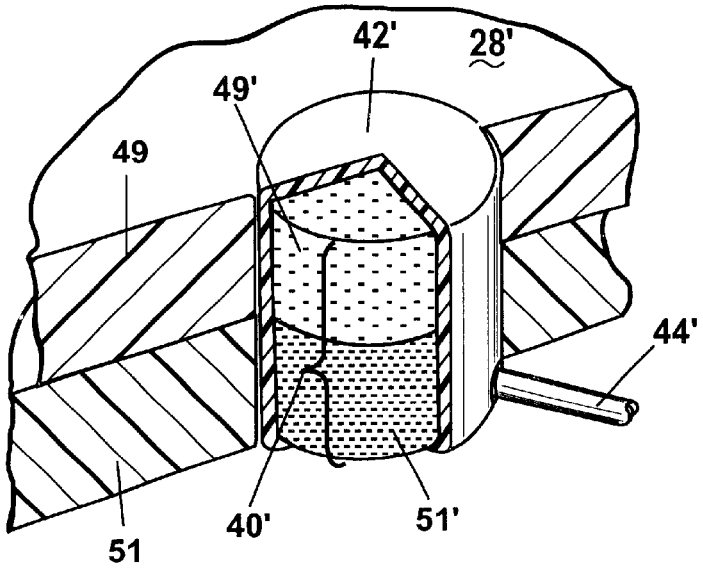
FIG. 10 illustrates an alternative construction for the cells of a therapeutic seat according to the invention.

FIGS. 9 and 10 illustrate an alternative seat and cell design comprising multiple layers of stacked foam and an alternative cell pattern. The seat 20' comprises a cushion 22' having a bottom layer 51 and a top layer 49. The bottom layer 51 is preferably made of polyurethane foam, which is very resilient and generally responds with a force equal to the applied force. The top layer 49 is preferably made from viscoelastic foam and responds with less force than an applied force. Therefore, the top layer is softer than the more firm bottom layer and is more comfortable to a user than a single foam seat.

The seat 20' has thirteen cells 30' that are formed in substantially the same manner as the single layer cells 30. The cells 30' preferably comprise cores 40' having a bottom layer 5' and a top layer 49'. A fluid conduit 44' extends from the bottom layer. Both layers are encapsulated by a bladder 42'. The operation of the cells 30' is similar to the operation of the cells 30, except that the cells 30' are inflated in zones, preferably three inflation zones. The three inflation zones are illustrated by the surface pattern of the cells 30'. The cells 30' with the same surface pattern are inflated and deflated together.

The first alternative cell pattern of FIG. 9 provides for the ischial areas 14 and 12 and the coccyx area 10 to overlie multiple cells 30'. This particular orientation provides for greater control in relieving the pressure from the coccyx and ischial areas. Furthermore, this configuration provides for better adaptation of the seat to users of different sizes whose specific coccyx and ischial bony protrusion locations are different than those of a standard adult male or female and those who cannot sit in a "normal" position because of deformity or disease. That is, additional cells 30' are provided about the seat 20' in front of and laterally of the coccyx and ischial areas to provide more support of the body portions surrounding the coccyx and ischial areas. The addition of the cells 30' underneath the surrounding body portions provides additional control over non-weight-bearing areas where decubitus ulcers can, but infrequently, form along with providing greater comfort for the user. Advantageously, the additional cells 30' also support the pelvic area in which decubitus ulcers are known to form although not at the same frequency or likelihood as the in coccyx area or ischial area.

Figure 11:
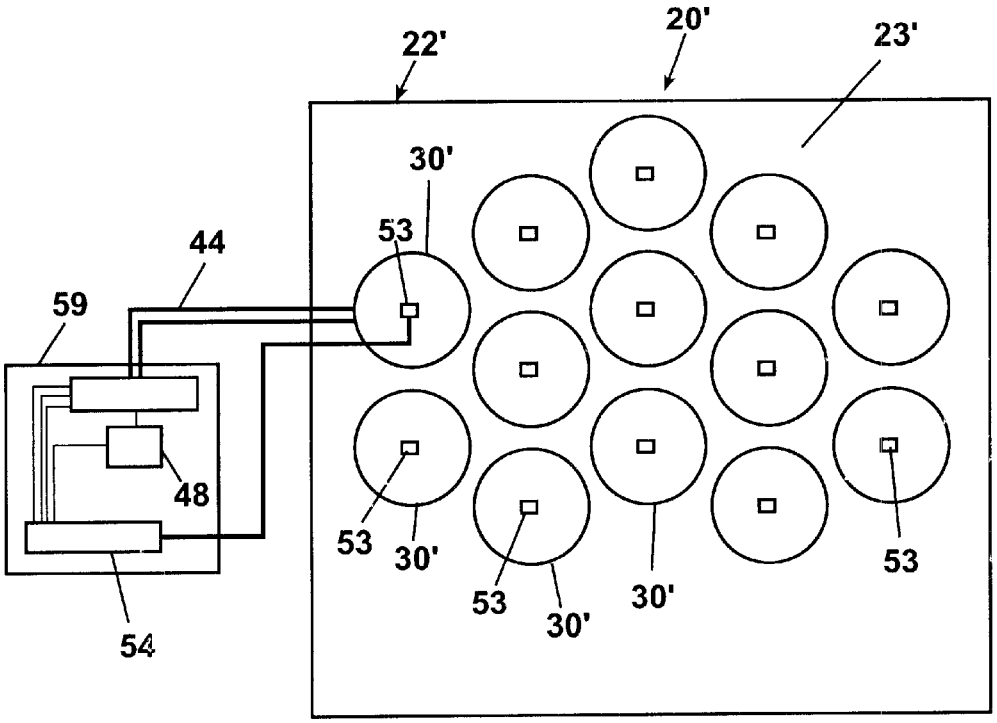
FIG. 11 illustrates a pressure sensing control system for the alternative cell pattern of FIG. 9.

FIG. 11 illustrates an alternative control system for the seat 20 of FIG. 9. The alternative control includes placing individual pressure sensors 53 within each of the cells 30' and connecting the pressure sensors 53 to the processor 56. The processor 54 receives a signal from the pressure sensors that is representative of the force on its associated cell. Each cell is then inflated and deflated based on its measured force. The microprocessor can also take into account the force on the adjacent cells.

Figure 12:
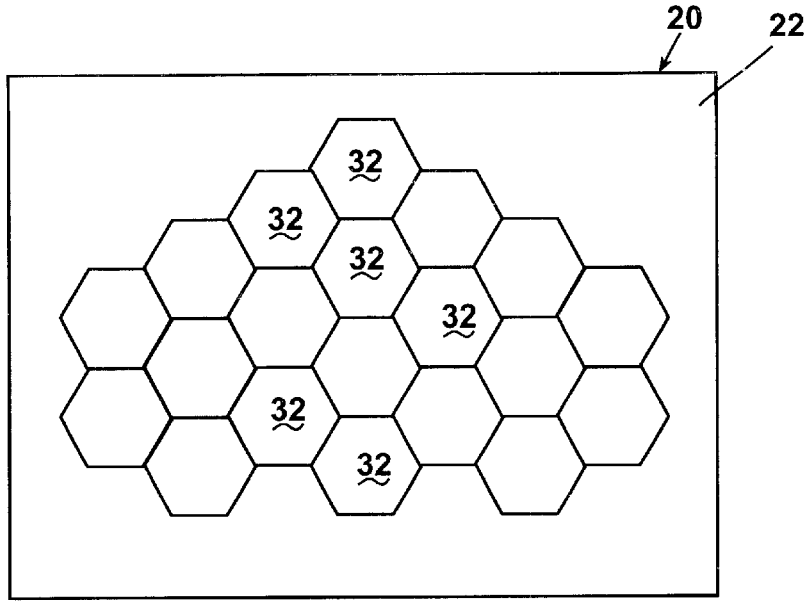
FIG. 12 illustrates a second alternative cell pattern for the cells of a therapeutic seat according to the invention.

FIG. 12 illustrates a second alternative cell pattern for the therapeutic seat 20 according to the invention. The alternative cell patterns are fluidly connected to and controlled by the control system of FIG. 6 in the same manner as previously described. Therefore the operation of the alternative cell patterns will not be described in detail.

FIG. 12 illustrates a second alternative cell pattern comprising hexagonal-shaped cells 32. The hexagonal-shaped cells 32 are contiguous and provide for control of the pressure across the entire area covered by the cells 32, which is advantageous over the discretely located cells 30 of the first alternative cell pattern because of the continuous control provided by the contiguous cells.

Figure 13:
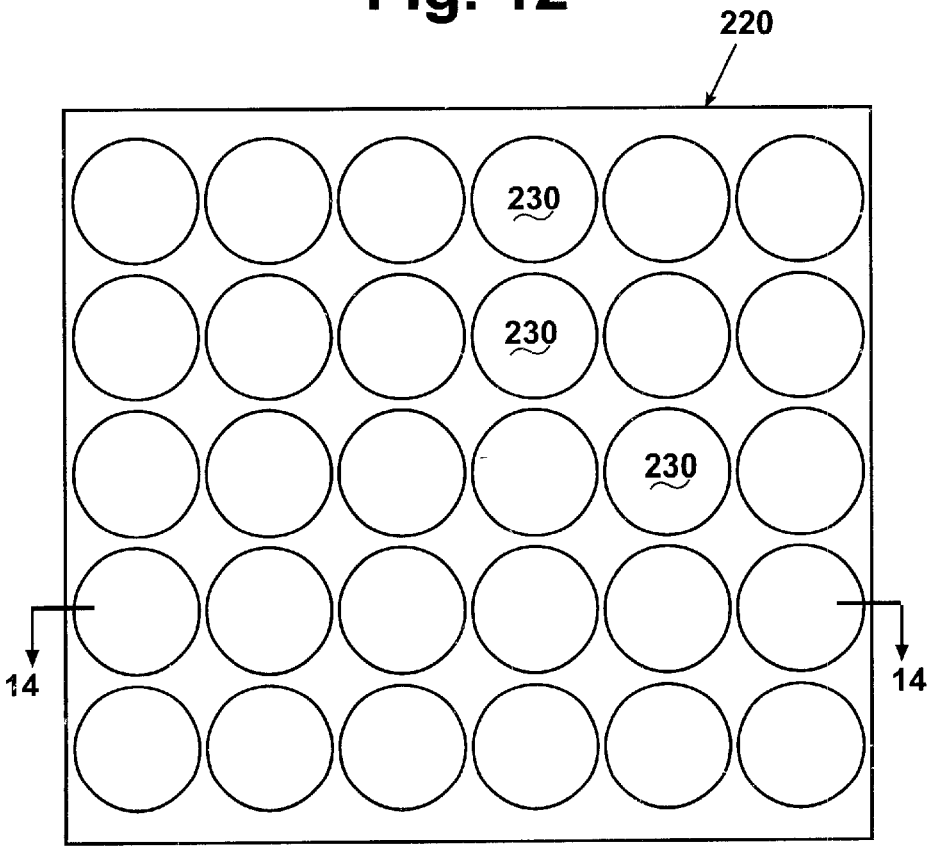
FIG. 13 illustrates a second embodiment of a therapeutic support according to the invention.
Figure 14:
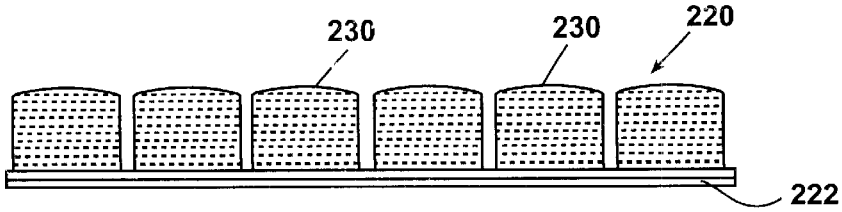
FIG. 14 is a sectional view taken along line 13—13 of FIG. 13.

FIGS. 13 and 14 illustrate a second embodiment of a therapeutic support according to the invention, this embodiment also comprising a therapeutic seat 220. In the second embodiment, the seat 220 comprises a base 222 on which are provided multiple cells 230. Unlike the previous embodiment, the multiple cells 230 are not surrounded by a cushion. The multiple cells 230 are illustrated as being spaced from each other and arranged in rows and columns. However, the multiple cells 230 could be in physical contact with adjacent cells and arranged in a variety of patterns, including staggered rows or columns. The base 222 is preferably made from plastic such as PVC or metal such as aluminum. The cells 230 are preferably made in the same or similar manner as cells 30. Also, the cells 230 can be inflated or compressed in the same manner as described herein.

Figure 15:
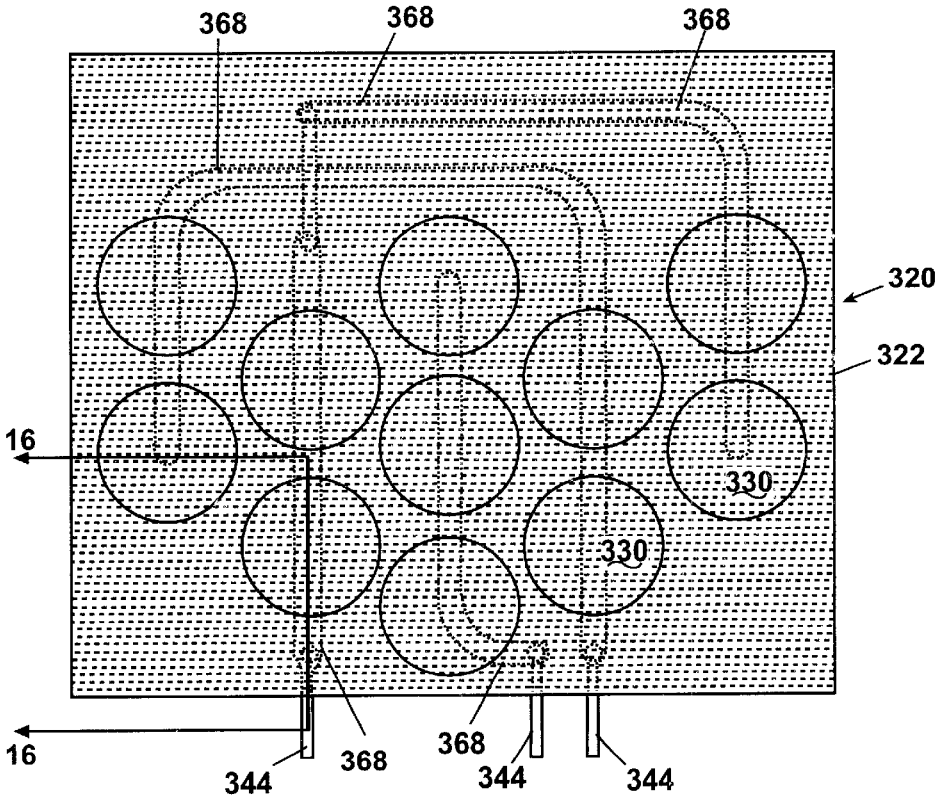
FIG. 15 illustrates a third embodiment of a therapeutic support according to the invention.
Figure 16:
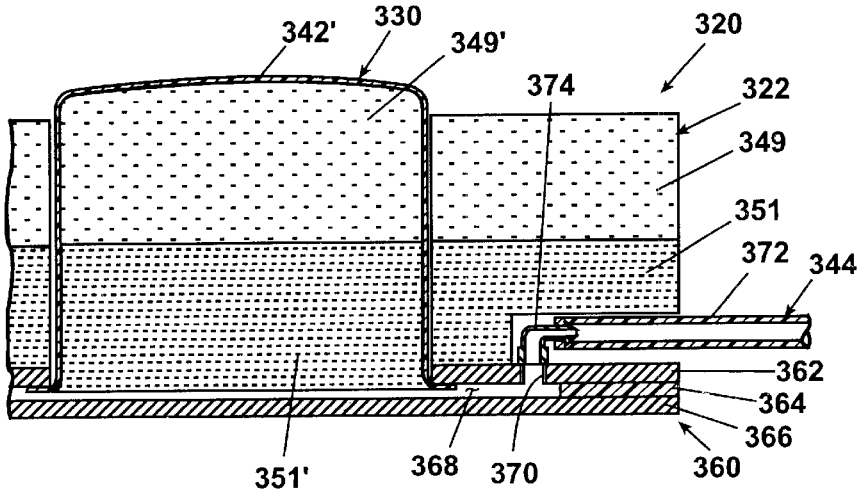
FIG. 16 is a sectional view taken along line 15—15 of FIG. 15.

FIGS. 15 and 16 illustrate a third embodiment of a therapeutic support according to the invention, this embodiment also comprising a therapeutic seat. In the third embodiment, the therapeutic seat 320 comprises a seat cushion 322 in which are provided multiple cells 330, whose state can be altered between a compressed state, relaxed state, and inflated state as previously described herein. The cells 330 can also be made in any of the forms described herein.

The cells 330 are arranged in five columns, with the center column comprising three cells and the remaining columns having only two cells. For description purposes, the columns will be referred to as the first through the fifth columns as they appear from left to right in FIG. 15.

The cells 330 of the first and fourth columns are fluidly connected by a first fluid conduit 344. The cells 330 of the second and fifth columns are fluidly connected by a second fluid conduit 344. The cells in the third column are connected by a third fluid conduit 344.

The fluidly connected cells of the first and third columns form a first zone. The fluidly connected cells of the second and fifth columns form a second zone. Similarly, the fluidly connected cells of the third column form a third zone. The state of the cells in the different zones can be changed from a compressed, relaxed, and inflated state independently of the cells in the other zones. The control of the state of the cells in the various zones can be accomplished in any of the manners described herein.

As best seen in FIG. 16, the cells 330 and seat cushion 322 have a dual layer construction. The cushion 322 has a bottom layer 351 and a top layer 349. Each cell 330 has a bottom layer 351' and a top layer 349'. The seat and cell bottom layers are preferably made of a polyurethane foam. The seat cell top layer are preferably made from a viscoelastic foam.

The foam layers 349' and 351' of the cells 330 are substantially encapsulated by a bladder 342', except that the bottom surface of the bottom foam layer 351' is left open.

The seat 322 further includes a base 360 made from three layers 362, 364, 366 of plastic such as PVC or metal such as aluminum. The lower edges of each cell bladder 342' are disposed between the first and second layers 362, 364 of the base 360 to secure the cell to the base. The second layer 364 has hollowed portions 368 that extend below the cells 330 to fluidly connect the various cells of each zone. The hollow portion 368 forms part of the fluid conduit 344 for each zone. The conduit 344 includes an aperture 370 provided in the upper layer 362 to fluidly connect the hollow portions 368 to a tube 372 via a connector 374 affixed to the upper surface of the upper layer 362. A portion of the bottom layer 351 of the cushion 322 is removed to accommodate the connector 374 and the tube 372. The tubes 372 and the connector 374 also form part of the fluid conduit 344. The structure of the connector and tube can also be used where one of the conduits must cross over another conduit to link the cells of a preferred base.

Figure 17:
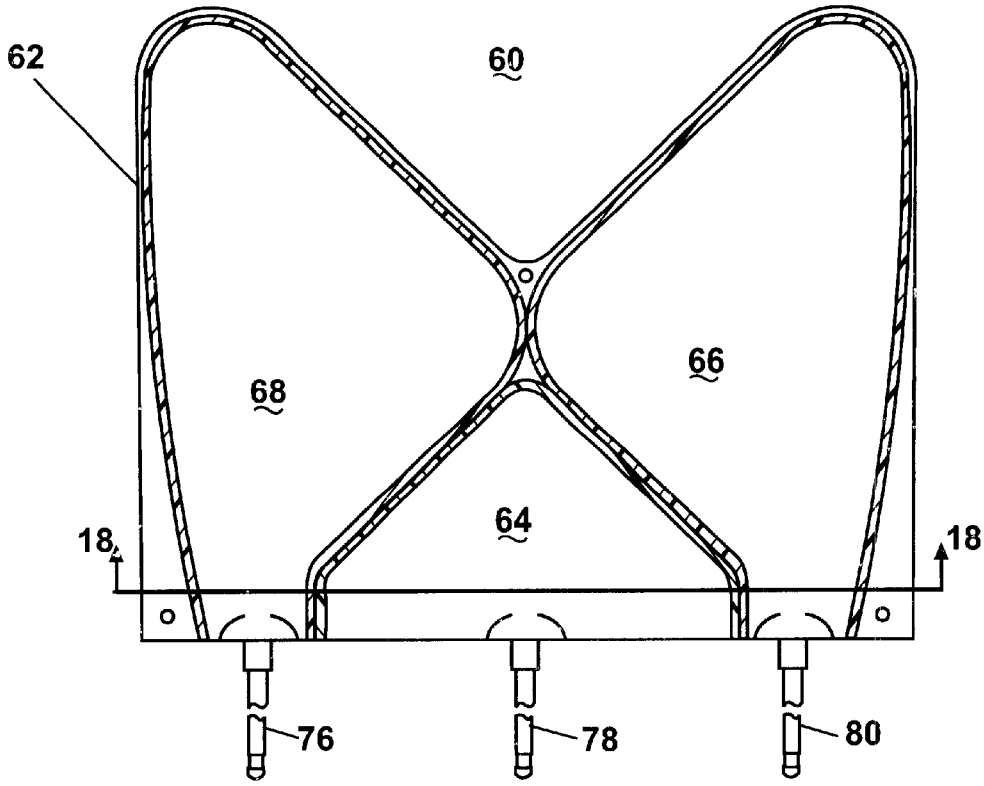
FIG. 17 is a plan view of a second embodiment of a therapeutic support according to the invention, also comprising a therapeutic seat, which shows three compressible chambers corresponding to the coccyx and ischial areas.
Figure 18:
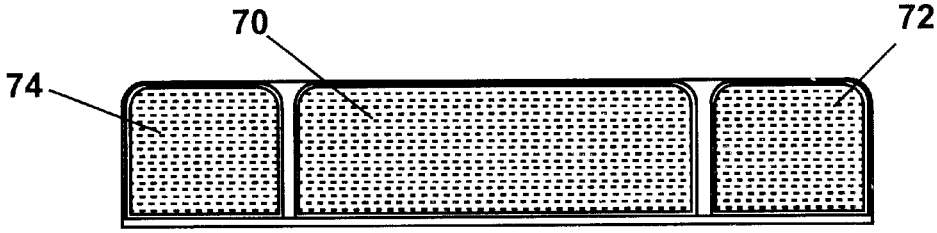
FIG. 18 is a sectional view taken along line 17—17 of FIG. 17.

FIGS. 17 and 18 illustrate a fourth embodiment of a therapeutic support according to the invention, this embodiment also comprising a therapeutic seat. In this embodiment, a therapeutic seat 60 comprises a bladder 62 having three compressible cells 64, 66, and 68. Cells 66 and 68 are lateral chambers each located at the side of the therapeutic seat 60 and provide most of the support for the ischial areas. Cell 64 is centrally located between the lateral cells 66 and 68 and provides most of the support for the coccyx area The bladder 62 is preferably covered by a suitable material cover (not shown) in the completed seat. Alternatively, additional cushioning layers may be disposed on top of and/or below of the bladder, depending upon the particular construction of the seat. Each of the compressible chambers 64, 66, and 68 contains a compressible core 70, 72, and 74, respectively, preferably made from an open cell, anti-microbial foam, and a fluid conduit or outlet tube 76, 78, and 80, each of which is connected to a vacuum pump 48.

The control system of FIG. 6 is preferably used to control the operation of the seat 60 in the same manner as described with respect to the first therapeutic seat. Therefore, the operation of the seat 60 will only be generally described with the understanding that the operation of the control system of FIG. 6 applies to the embodiments of FIGS. 12–18.

In operation, the compressible cells 64, 66, 68 of the therapeutic seat 60 are initially in a relaxed state, where they are open to atmospheric pressure and the upper surface of the cells form an overall coextensive surface for supporting the weight-bearing and non-weight-bearing portions of the user's body. After the person is seated on the therapeutic seat 60, each of the compressible cells 64, 66, 68 are moved through a sequence of compressed, relaxed, and or inflated states as programmed to alter the pressure applied to the coccyx and ischial areas of the person to permit normal or near-normal capillary blood flow and retard the formation of decubitus ulcers.

As in the first embodiment of FIG. 2, the selected compressible cells 64, 66, 68 are preferably in the compressed state for 40 seconds and in the relaxed state for 10 seconds. However, they may be in any sequence or combination of the compressed, relaxed and inflated states at any desired timing interval and sequence. The only controlling factor regarding the timing and sequence of the deflation and inflation of the compressible cells 64, 66, 68 is that sufficient capillary blood flow be provided to the coccyx area and the ischial areas to prevent the formation of decubitus ulcers.

The bladder 62 may be made of a porous fabric or a perforated non-porous fabric, either of which would permit fluid to be drawn into the core 70 of the compressible chambers, where it would be carried away through the corresponding outlet tubes 76, 78, 80. Therefore, the therapeutic seat 60 additionally reduces the likelihood of a decubitus ulcer by removing moisture from the coccyx area and the ischial areas of the seated person.

Figures 19, 19A, 19B, 19C:
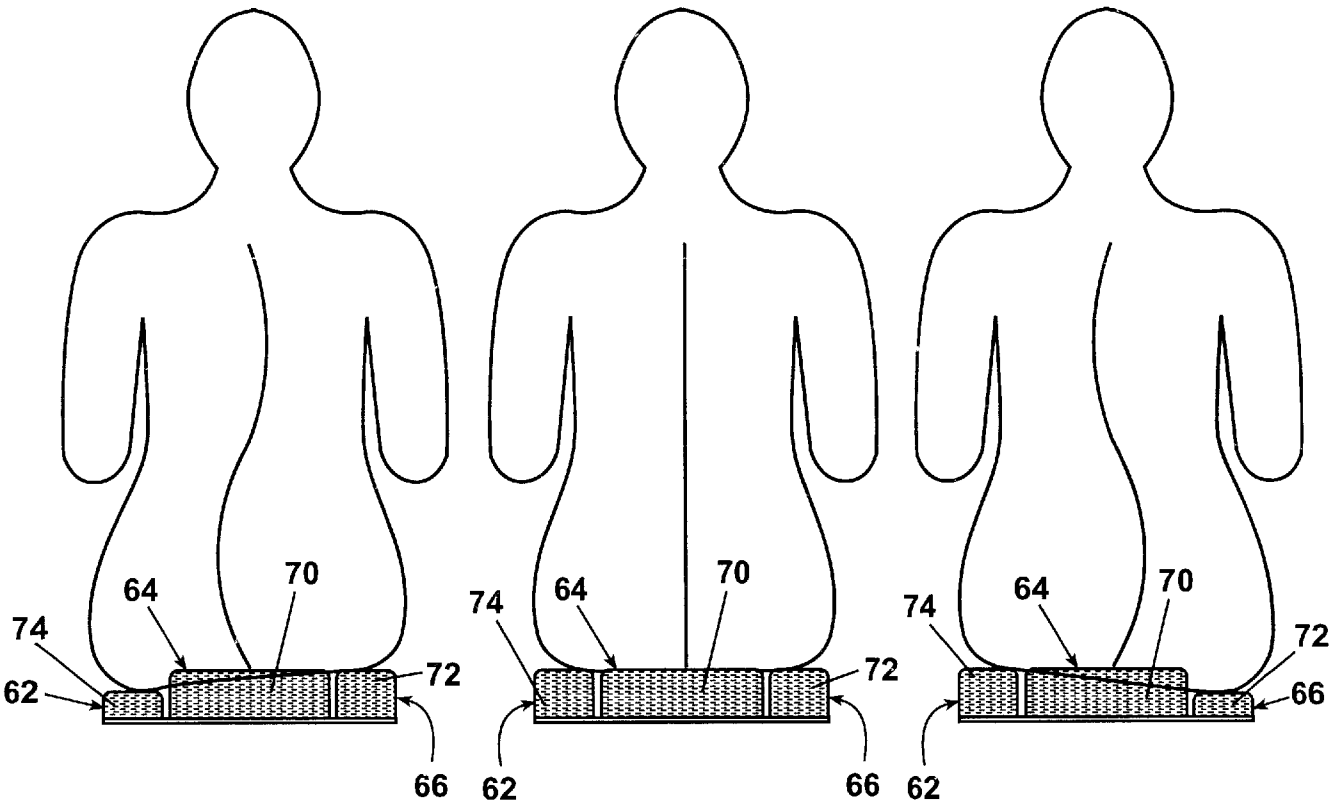
FIG. 19 is a diagrammatic representation comparing spinal column orientation of a person seated on the therapeutic seat of FIGS. 17 and 18 when one of the lateral cells is compressed (FIGS. 19*a*, 19*c*) to the spinal column orientation when no cells are compressed (FIG. 19*b*)
Figures 20, 20A, 20B:
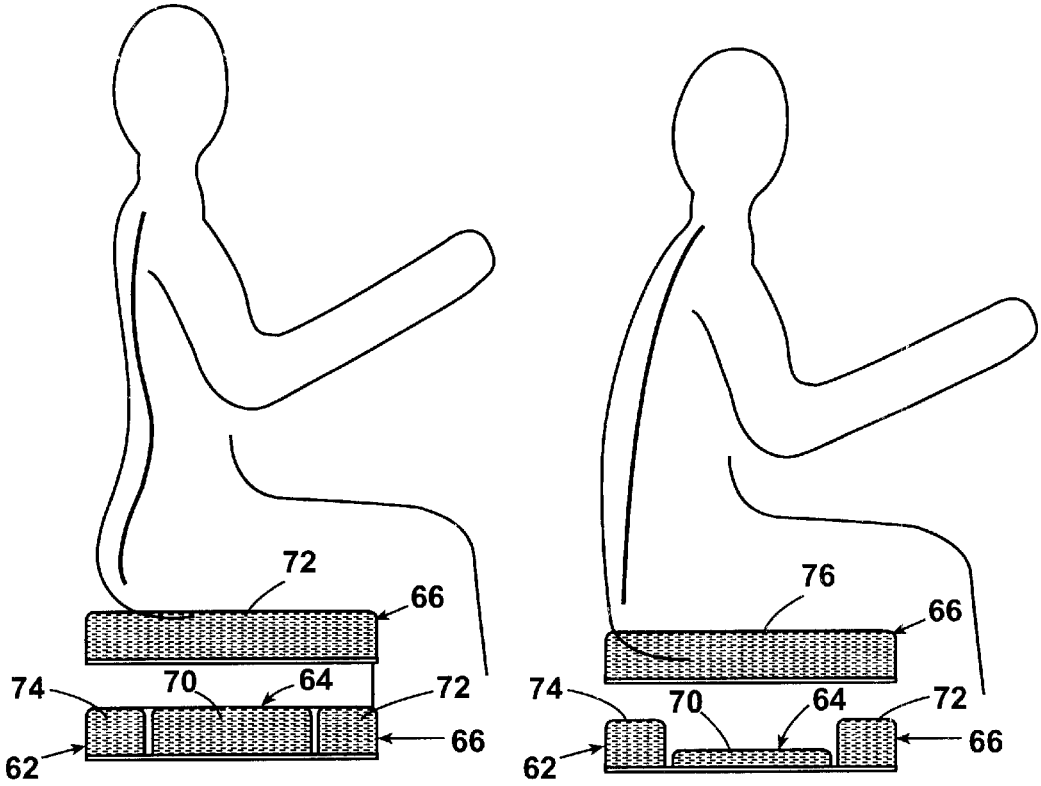
FIG. 20 is a diagrammatic representation comparing the spinal column orientation of a person seated on the therapeutic seat of FIGS. 17 and 18 when no cell is compressed (FIG. 20*a*) to the spinal column orientation when a center cell is compressed (FIG. 20*b*)

As best seen in FIGS. 19 and 20, the therapeutic seat 60 reduces the pressure in the coccyx and ischial areas by altering the body position or orientation of the seated person to redistribute weight between the coccyx area and the ischial areas instead of transferring weight to the areas surrounding the coccyx area and ischial areas as in the first embodiment of the invention comprising therapeutic seat 20.

Referring to FIG. 19, as one of the lateral compressible cells 66 or 62 is compressed relative to the other lateral compressible chamber (FIGS. 19*a*, 19*c*), the corresponding ischial area 12 or 14 is lowered resulting in a curvature of the spinal column relative to the spinal column orientation subsisting when all the cells are relaxed (FIG. 19*b*). The resultant spinal curvature transfers the person's weight from the ischial area above the deflated lateral chamber to by the ischial area above the inflated lateral chamber and the coccyx area.

Referring to FIG. 20, as the center compressible cell 64 is compressed relative to the relaxed lateral compressible cells 66 and 62, the spinal column is curved forwardly and more of the seated person's weight is carried by the ischial areas 12 and 14, thus relieving pressure from the coccyx area 10. By combining various patterns and combinations of the compressed and relaxed states of the compressible cells 64, 66, and 62, it is possible to vary the percentage of weight borne by the coccyx area and ischial areas of the seated person, which permits increased capillary blood flow in the areas bearing reduced weight. Additionally, one or more of the cells held in the inflated state could alter the orientation of the spinal column to shift the weight between various combinations of the coccyx and ischial areas.

FIGS. 21–25 illustrate alternative cell patterns for the therapeutic seat 60. The alternative cell patterns can be controlled by the control system of FIG. 6. Therefore, the operation of the alternative cell patterns will not be described in detail.

Figure 21:
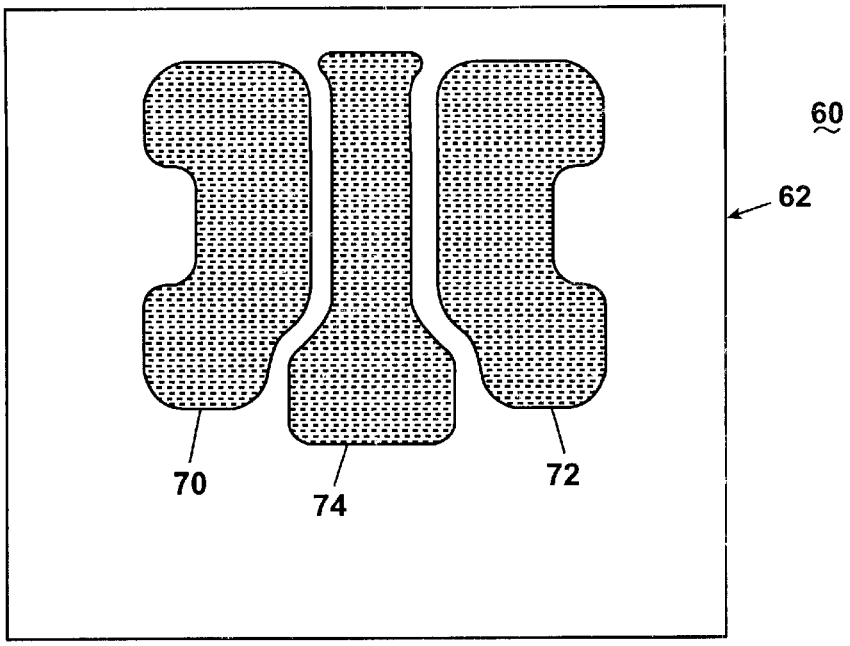
FIG. 21 illustrates a first alternative cell pattern for the therapeutic seat of FIGS. 17 and 18.
Figure 28:
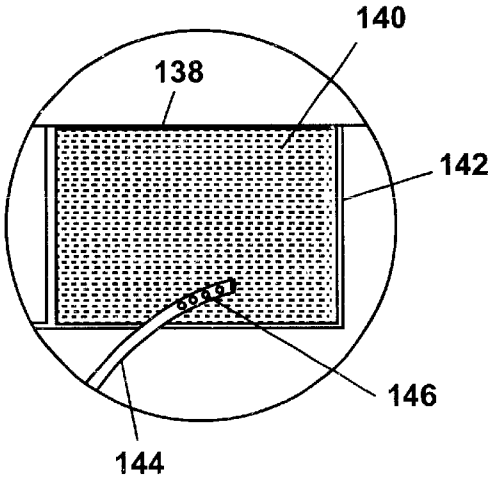
FIG. 28 is an enlarged view of one of the cells of FIG. 27, further illustrating the cell construction, particularly a fluid conduit associated with the cell.

FIG. 21 illustrates a first alternative cell pattern comprising lateral cells 70, 72 between which is disposed a central cell 74. The lateral cells 70 and 72 generally support the ischial areas whereas the center cell 74 generally supports the coccyx and pelvic area. Unlike some of the previous cell patterns, the cell pattern of FIG. 28 provides for relieving pressure from the pelvic area as well as the coccyx and ischial areas.

Figure 22:
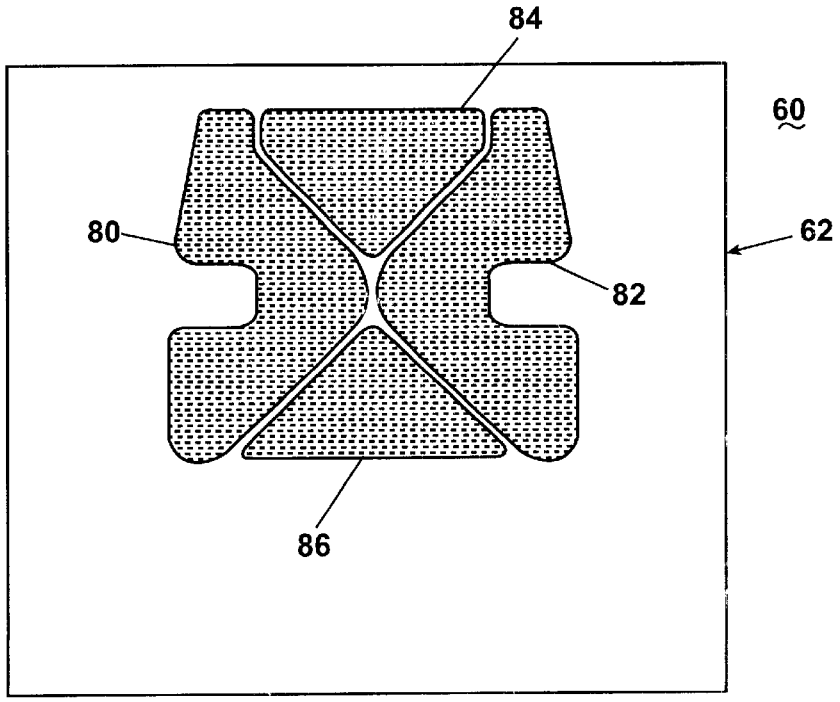
FIG. 22 illustrates a second alternative cell pattern for the therapeutic seat of FIGS. 17 and 18.

FIG. 22 illustrates a second alternative cell pattern comprising triangularly shaped lateral cells 80, 82 and front and rear cells 86, 84. The junction of the cells 80 through 86 define an X-like shape with the apexes of each cell 80–86 directed toward the center of the X. The lateral cells 80, 82 support the ischial areas of a body positioned on the seat. The rear cell 84 supports the coccyx area of the body and the front cell 86 supports the pelvic area of the body.

Like the first alternative cell pattern, the second alternative cell pattern also supports the pelvic area in addition to the coccyx and ischial areas of the body. One additional advantage of the second alternative cell pattern is that the coccyx and pelvic areas are individually supported by their corresponding cells 84, 86, respectively, which provides for independently relieving the coccyx and pelvic areas from pressure by independently holding the cells 84 and 86 in the compressed state, relaxed state, or inflated state.

Figure 23:
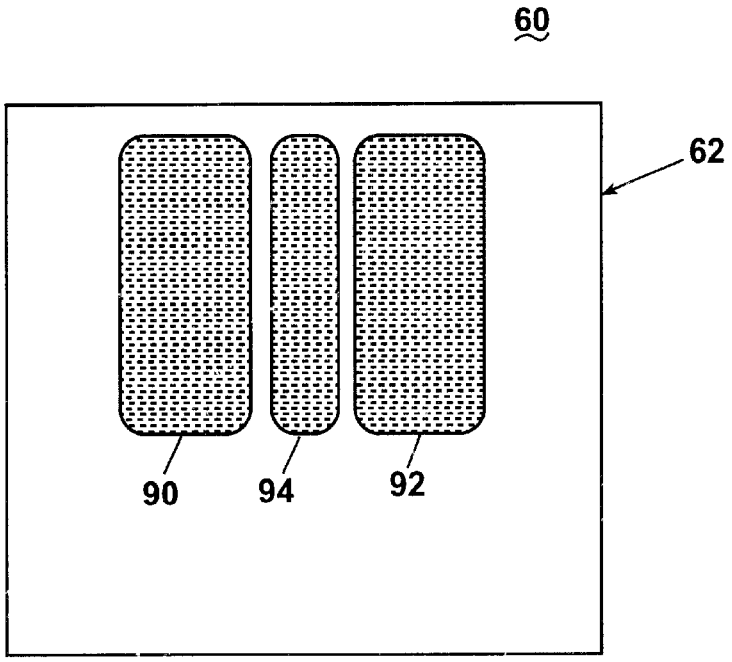
FIG. 23 illustrates a third alternative cell pattern for the therapeutic seat of FIGS. 17 and 18.

FIG. 23 illustrates a third alternative cell pattern comprising lateral cells 90, 92 and center cell 94. As with the first and second alternative cell patterns, the third alternative cell pattern is capable of supporting both the coccyx and ischial areas along with the pelvic area. The lateral cells 90 and 92 are of enlarged width to provide for control over a greater lateral area.

Figure 24:
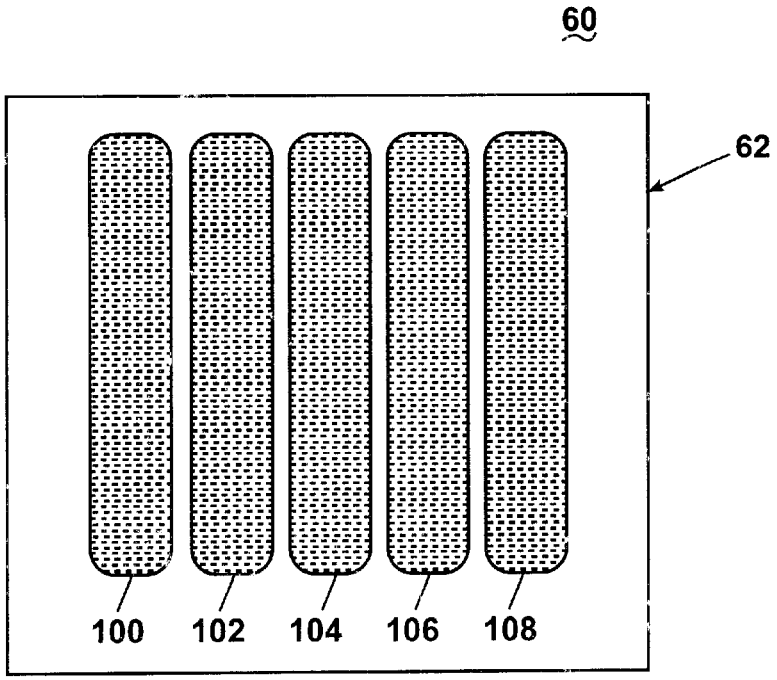
FIG. 24 illustrates a fourth alternative cell pattern for the therapeutic seat of FIGS. 17 and 18.

FIG. 24 illustrates a fourth alternative cell pattern comprising a plurality of equally sized cells 100, 102, 104, 106, 108, arranged front to rear longitudinally relative to the seat 20. The cells 102 and 106 are generally positioned to support the ischial areas of the body and the cell 104 supports the coccyx and pelvic areas of the body. The end cells 100–108 support the portion of the body exterior to the ischial areas. The addition of the exterior cells 100 and 108 provides greater control in shifting the user's weight from the coccyx area and ischial areas to the surrounding areas of the body, which is especially useful for a person having a physical deformity or disease that prevents sitting normally. For example, while it is possible to relieve pressure from the ischial areas by moving the cells 102, 106 to a compressed state and leaving the other cells at the relaxed state, a similar effect can be obtained by inflating the exterior cells 100, 108 while leaving the cells 102, 104, 106 in the relaxed state. Greater pressure relief from the ischial areas can be attained by inflating the center cell 104 along with the exterior cells 100, 108. Advantageously, any desirable combination of the cells 100 through 108 in the various states can be attained with the control system according to the invention. The various combinations will depend on the particular needs and physical requirements of each user.

Figure 25:
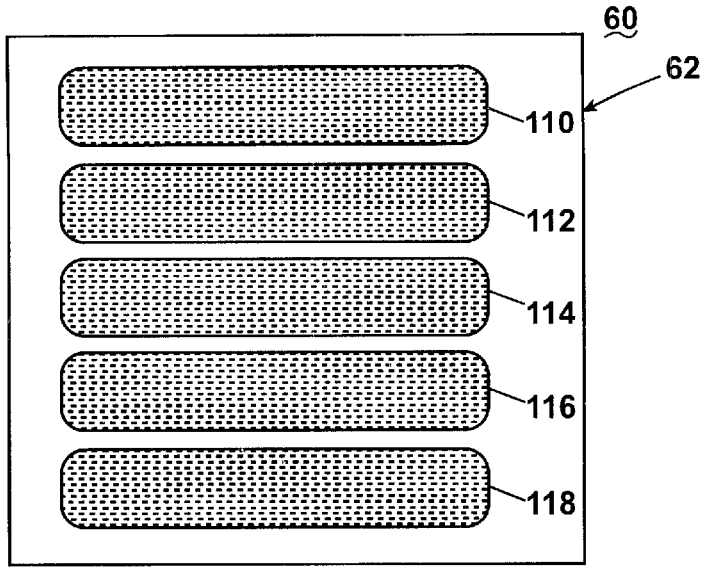
FIG. 25 illustrates a fifth alternative cell pattern for the therapeutic seat of FIGS. 17 and 18.
Figure 26:
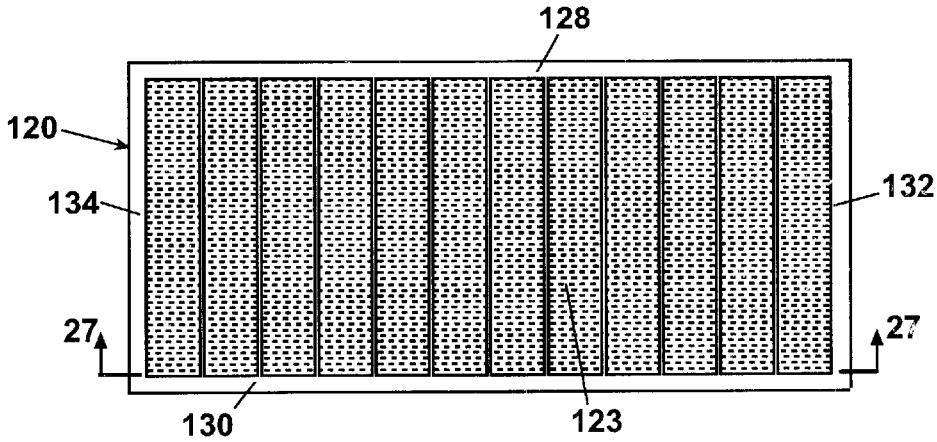
FIG. 26 is a plan view of a third embodiment of a therapeutic support according to the invention, comprising a bed having a mattress with multiple cells.

FIG. 25 illustrates a fifth alternative cell pattern comprising a plurality of substantially equally sized cells 110, 112, 114, 118 that are arranged in a transverse orientation with respect to the seat 20 and which is particularly suited for a person with a physical deformity or disease that prevents normal sitting. The fifth alternative pattern is similar to the fourth alternative pattern except for the 90-degree difference in their orientation. As the fourth alternative pattern is beneficial in transferring weight laterally between the ischial areas and the coccyx areas along with the surrounding portion, the fifth alternative pattern is most suited to transferring the weight longitudinally between the ischial areas, coccyx area, and surrounding body portion.

FIGS. 26–29 illustrate a third embodiment of a therapeutic support according to the invention, comprising a therapeutic mattress 120 having a base support structure 122, preferably comprised of PVC firm foam, and a therapeutic support 123. The structural support 122 comprises a base 124 and a peripheral upstanding wall 126, which can be conceptually divided into sidewalls 128, 130 and end walls 132, 134.

The base 124 and peripheral wall 126 of the structural support 122 define a recess in which is held the therapeutic support 123. The therapeutic support 123 comprises a plurality of cells 136. Preferably, the cells are oriented transversely with respect to the structural support 122 or, in other words, parallel to the end walls 132, 134. An outer cover layer 138,extends across the entire surface of the structural support 122 and support 123. The exterior cover, like that of the therapeutic seat embodiments previously described, can be made from any suitable material.

Figure 27:
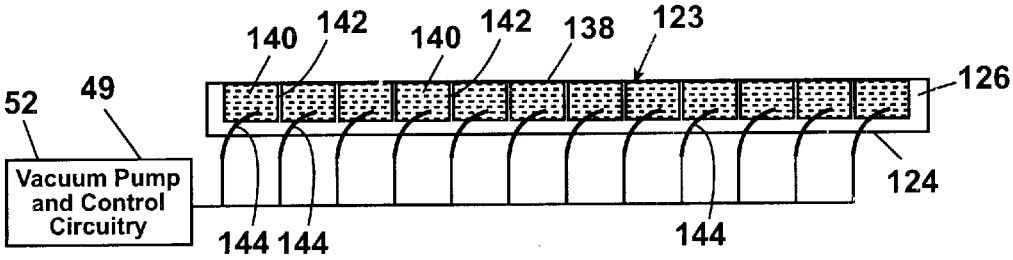
FIG. 27 is a sectional view taken along line 27—27 of FIG. 26, illustrating the construction of the cells of the mattress.

Referring to FIGS. 27 and 28, each of the cells 136 comprises a core 140 encapsulated by a bladder 142. A fluid conduit 144 extends through the interior of the core 140 and out through the bladder 142 where it is connected to a control system substantially identical to that disclosed in FIG. 6.

The control system can hold the cells 136 in the compressed, relaxed, and inflated states as previously described with respect to the first and second embodiments of the invention. Similarly, the cells 136 can be held in these various states simultaneously, sequentially, or any other desired pattern. The operation of the cells 136 is substantially similar to the operation previously described in connection with the first and second embodiments of the invention; therefore, the operation of the cells 136 will not be described in detail.

The fluid conduits 144 of the cells 136 preferably extend substantially along the entire width of each of the cells. To ensure that the cells 136 can be evenly compressed, relaxed, or inflated, each of the fluid conduits 144 has a plurality of openings 146 extending along the portion of the fluid conduit 144 contained within the bladder 142.

The cells 146 can be manufactured as individual elements or as one unit. In either case, it is within the scope of the invention for the upper surface of the bladder of each cell to be made from a permeable material to permit fluid to be drawn into the core 140 where it can be disposed through the control system.

Figure 29:
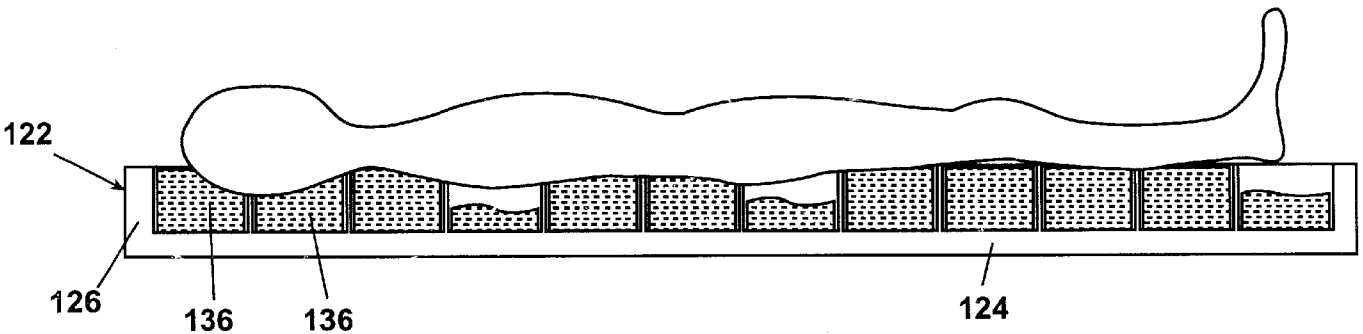
FIG. 29 is a longitudinal sectional view of the bed of FIG. 26, illustrating operation of the mattress with a person lying thereon in a supine position.

Referring to FIG. 29, the cells 136 are generally kept in the relaxed state prior to the placing of a user on the therapeutic support 123 of the bed 120. As in the previously described embodiments of the invention, the user or aid enters the various operational parameters. The control system then moves the cells 136 from the initial relaxed state to either the compressed or inflated state as programmed and continues moving the selected cells through the various states as selected.

As the patient is generally in the supine position, as illustrated in FIG. 29, the weight-bearing areas for the patient include the shoulder areas, ischial areas, coccyx area, and heel area and to a lesser extent, the wrist area, elbow area, and ankle area. Therefore, most of the moving of the cells from the relaxed state to the compressed state or inflated state will occur in the cells corresponding to these weight-bearing areas.

Although the mattress is described in the context of a person in the supine position, the mattress can accommodate a person in any position, including the prone position and lying on either side, for example.

Figure 30:
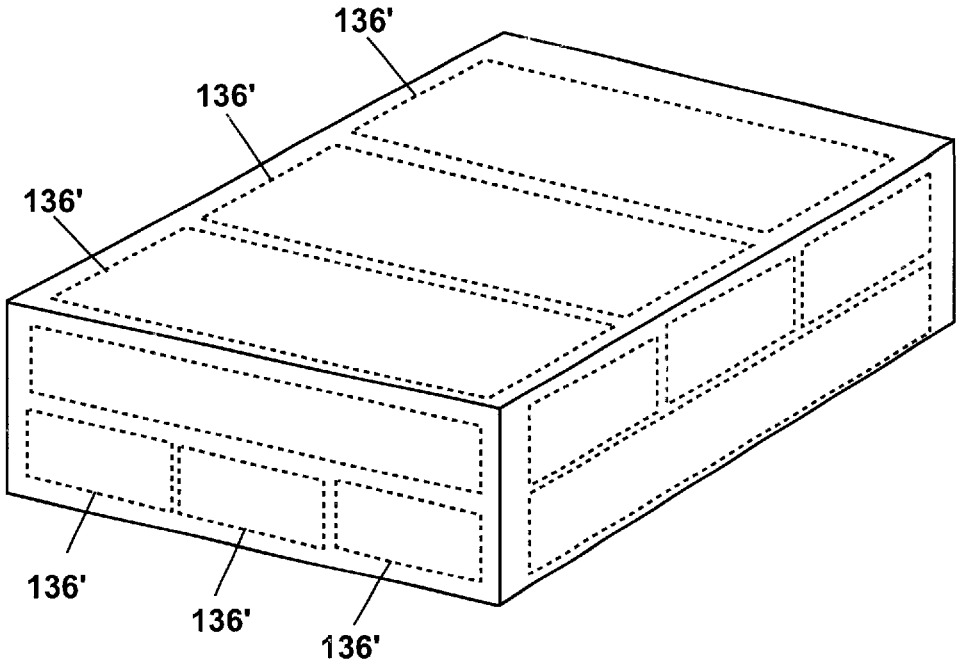
FIG. 30 illustrates an alternative cell construction for the bed of FIG. 26.

FIG. 30 illustrates an alternative cell construction for the therapeutic support 123'. In the alternative construction there are two stacked layers of cells 136' and 136". Preferably, the two stacked layers of cells 136', 136" provide for greater control and sensitivity than the single cell layer 136 and can be controlled in the same manner described for the stacked cell of FIG. 9.

Figure 31:
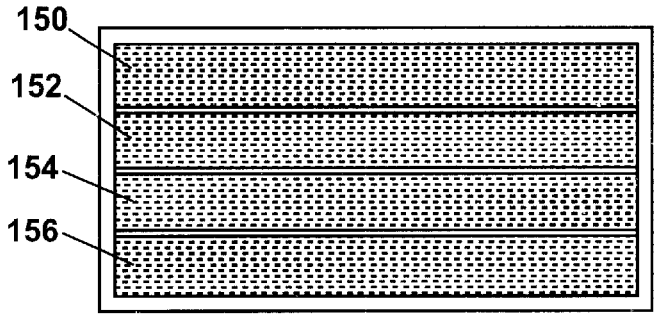
FIG. 31 illustrates a first alternative cell pattern for the bed of FIG. 26.
Figure 32:
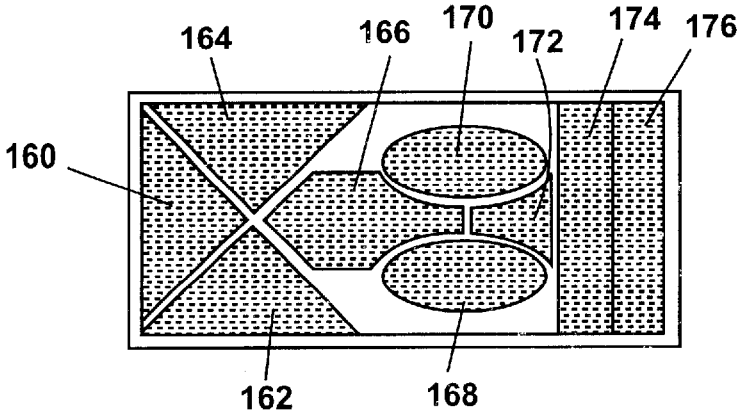
FIG. 32 illustrates a second alternative cell pattern for the bed of FIG. 26.

FIGS. 31 and 32 illustrate alternative cell patterns for the therapeutic bed 120. The alternative cell patterns are controlled in substantially the same way as previously described in connection with the three embodiments of the invention. Therefore, the control and operation of the alternative cell patterns will not be described in detail.

FIG. 31 illustrates a first alternative cell pattern comprising longitudinally oriented cells 150, 152, 154, 156. Although only four longitudinal cells are shown, more longitudinal cells may be provided if greater control is desired over more discrete or finer areas of the user's body.

FIG. 32 illustrates a second alternative cell pattern comprising a triangular head cell 160, shoulder cells 162, 164, spinal cell 166, opposing ischial cells 168, 170, pelvic cell 172 and heel cells 174, 176. The second alternative cell pattern provides a great deal of independent control over the various weight-bearing portions of a person in the supine position since there is a separate cell located at each potentially weight-bearing portion of the body. Each of the cells 162–176 is independently controlled by the controller. Therefore, the cells can be independently moved through any combination of the compressed, relaxed, or inflated states.

It will be understood that embodiments other than those illustrated and described herein may be devised within the scope of the invention to accommodate individuals and particular conditions. For example, the scrotum is often a vulnerable location in a male seated for long periods, and a therapeutic seat according to the invention may readily be configured to alleviate risk to that part of the body.

While the invention has been particularly described in connection with certain specific embodiments thereof, it is to be understood that this is by way of illustration and not of limitation, and the scope of the appended claims should be construed as broadly as the prior art will permit.

I claim:

1. A therapeutic support for supporting a posterior body portion of a person and reducing pressure at a weight-bearing area of the posterior body portion to improve blood flow in the weight-bearing area and thereby aid in the healing of decubitus ulcers and reduce the likelihood of the formation thereof at the weight-bearing area, the therapeutic support comprising:

a cushion having an upper surface, the cushion being sized to support at least one weight-bearing area of the nosterior body portion placed in contact with the upper surface and formed with a cell cavity at a location corresponding to a weight-bearing portion of the posterior body portion; and a compressible cell received in the cell cavity and having a configuration complementary thereto, having an upper surface and the cell being compressible from a relaxed state to a compressed state;

whereby, when the compressible cell is in the relaxed state, the upper surface of the cushion and the upper surface of the cell support the weight-bearing area of the posterior body portion and the surrounding non-weight-bearing area, and when the cell is in the compressed state, pressure on the weight-bearing area is reduced.

2. A therapeutic support according to claim 1, wherein the cell upper surface is positioned below, level with, or above the cushion upper surface when the cell is in the relaxed state.

3. A therapeutic support according to claim 1, wherein the cell is expandable to an expanded state for applying a positive pressure to the weight-bearing area by the cell upper surface.

4. A therapeutic support according to claim 3, wherein the cell upper surface is positioned above the cushion upper surface when the cell is in the expanded state.

5. A therapeutic support according to claim 1 and further comprising multiple cells.

6. A therapeutic support according to claim 5, wherein the multiple cells are configured relative to the cushion to correspond to a single weight-bearing area.

7. A therapeutic support according to claim 5, wherein the cushion is sized to support multiple weight-bearing areas of a posterior body portion placed on the cushion and the multiple cells are configured relative to the cushion so that at least one cell corresponding to each weight-bearing area.

8. A therapeutic support according to claim 1, including a fluid conduit having one end portion thereof in fluid communication with the cell and another end portion thereof adapted to connect the fluid conduit to a vacuum pump, whereby to compress the cell by applying a negative pressure gradient thereto.

9. A therapeutic support according to claim 8, wherein the cell comprises a resilient compressible core and a flexible bladder enveloping the core, said one end of the fluid conduit extending into the bladder, whereby, when a negative pressure gradient is applied to the cell, fluid in the bladder is drawn out therefrom by way of the fluid conduit, thereby contracting the bladder to compress the core.

10. A therapeutic support according to claim 9, wherein the core is formed of open-cell foam.

11. A therapeutic support according to claim 10, wherein the open-cell foam is anti-microbial.

12. A therapeutic support according to claim 9, wherein the material of the bladder is selected from the group consisting of rubber and neoprene.

13. A therapeutic support according to claim 9, wherein the cell comprises an upper and lower foam layer.

14. A therapeutic support according to claim 13, wherein one of the foam layers is viscoelastic.

15. A therapeutic support according to claim 9, wherein the bladder is elastic and is expansible to an inflated state to elevate an upper surface portion of the bladder above the upper surface of the cushion in response to a positive pressure gradient applied to the fluid conduit.

16. A therapeutic support according to claim 9, wherein the fluid conduit comprises a tube having a peripheral wall formed with a plurality of openings therein.

17. A therapeutic support according to claim 16, wherein said one end portion of the fluid conduit extends substantially through the core of the cell and the openings are formed only in the peripheral wall at said one end portion.

18. A therapeutic support according to claim 1, wherein the cell has a plan form selected from the group consisting of circular, hexagonal, triangular, and rectangular plan forms.

19. A therapeutic support according to claim 1, wherein the cushion further comprises multiple cell cavities, with each cell cavity being located in the cushion at a position corresponding to a different weight bearing area of the posterior body portion, and a compressible cell is received in each of the cell cavities.

20. A therapeutic support according to claim 19, wherein the cushion cavities are spaced relative to each other.

21. A therapeutic support according to claim 19, wherein at least one of the compressible cells located in one of the cell cavities is formed of multiple compressible cells.

22. A therapeutic support according to claim 19, wherein there are three cavities and the cavities are located on the cushion at weight bearing areas corresponding to the coccyx and ischial areas of the posterior body portion.

23. A therapeutic support for supporting a posterior body portion of a person and reducing pressure at weight-bearing areas of the posterior body portion to improve blood flow in the weight-bearing areas and thereby aid in the healing of decubitus ulcers and reduce the likelihood of the formation thereof the therapeutic support comprising:

a cushion having an upper surface, the cushion being sized to support multiple weight-bearing areas of a posterior body portion placed in contact with the upper surface and formed with a plurality of cell cavities at locations respectively corresponding to the weight-bearing portions of the posterior body portion; and a plurality of compressible cells equal in number to the cell cavities, each of the cells being received in a respective cell cavity and having a configuration complementary thereto, each of the cells being compressible from a relaxed state to a compressed state, an upper surface portion of each of the cells being substantially at the height of the upper surface of the cushion when the cell is in the relaxed state, the upper surface portion of the cell being lower than the upper surface of the cushion when the cell is in the compressed state;

whereby, when any one of the cells is in the relaxed state, the upper surface of the cushion and the upper surface portion of said one cell form a substantially continuous surface for supporting the non-weight-bearing areas of the posterior body portion and the weight-bearing area thereof corresponding to said one cell, and when said one cell is in the compressed state, pressure on the corresponding weight-bearing area is reduced.

24. A therapeutic support according to claim 23, wherein at least one of the plurality of cells is provided for each weight-bearing area of the portion of the posterior body portion to be supported on the cushion.

25. A therapeutic support according to claim 23, wherein the cells are spaced from one another.

26. A therapeutic support according to claim 23, wherein the cells are contiguous.

27. A therapeutic support according to claim 23, wherein the cushion is adapted to form a portion of a wheelchair seat for supporting thereon a posterior body portion having weight-bearing areas comprising an ischial area and a coccyx area, and at least one of the compressible cells is disposed in a location corresponding to each of the weight-bearing areas.

28. A therapeutic support according to claim 27, wherein at least one of the compressible cells is disposed in a location corresponding to a weight-bearing pelvic area of a posterior body portion to be supported on the wheelchair seat.

29. A therapeutic support according to claim 23, wherein the cushion is adapted to form a portion of a mattress for supporting a posterior body portion having weight-bearing areas comprising a shoulder area, an ischial area, a coccyx area and a heel area.

30. A therapeutic support according to claim 29, wherein at least one of the compressible cells is disposed in a location corresponding to each of the weight-bearing areas.

31. A therapeutic support according to claim 30, wherein at least one of the compressible cells is disposed in a location corresponding to a weight-bearing head area of a body.

32. A therapeutic support according to claim 29, and further comprising a support frame having a bottom wall and a peripheral wall extending upwardly from the bottom wall, the bottom wall and peripheral wall defining a recess, and a plurality of the compressible cells being situated within the recess.

33. A therapeutic support according to claim 32, and further comprising an outer cover disposed over the support frame and the cells.

* * * * *

UNITED STATES PATENT AND TRADEMARK OFFICE

CERTIFICATE OF CORRECTION

PATENT NO. : 6,367,106 B1
DATED : April 9, 2002
INVENTOR(S) : Steven M. Gronsman It is certified that error appears in the above-identified patent and that said Letters Patent is hereby corrected as shown below:

Column 14,
Line 14, "nosterior" should be -- posterior --.

Signed and Sealed this

Fourth Day of June, 2002

*Attest:*

*Attesting Officer*

JAMES E. ROGAN
*Director of the United States Patent and Trademark Office*